US006406124B1

(12) United States Patent
Davis et al.

(10) Patent No.: US 6,406,124 B1
(45) Date of Patent: Jun. 18, 2002

(54) GANGED INKJET PRINTHEAD CAPPING SYSTEM

(75) Inventors: Jeremy A. Davis, Battle Ground, WA (US); Kris M. English, Portland; Jeffrey K. Pew, Lake Oswego, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/494,846

(22) Filed: Jan. 31, 2000

(51) Int. Cl.[7] ..... B41J 2/165
(52) U.S. Cl. ..... 347/32; 347/29
(58) Field of Search ..... 347/32, 29, 30, 347/22, 24; 401/243–247

(56) References Cited

U.S. PATENT DOCUMENTS

| | | | | | |
|---|---|---|---|---|---|
| 4,684,963 | A | * | 8/1987 | Naka | 347/29 |
| 5,146,243 | A | * | 9/1992 | English et al. | 347/29 |
| 5,614,929 | A | | 3/1997 | Dangelo et al. | 347/30 |
| 5,712,668 | A | | 1/1998 | Osborne et al. | 347/32 |
| 5,867,184 | A | | 2/1999 | Quintana | 347/29 |
| 5,956,053 | A | | 9/1999 | Michael | 347/29 |
| 6,074,037 | A | * | 6/2000 | Nakahara et al. | 347/29 |
| 6,220,689 | B1 | | 4/2001 | Sturgeon | 347/29 |

OTHER PUBLICATIONS

Hewlett–Packard Company Patent Application filed Jun. 24, 1998, Ser. No. 09/104,274, entitled "Unitary Capping System for Multiple Inkjet Printheads". Sturgeon patented, date Apr. 24, 2001, Pat. #6,220,689 B1.

* cited by examiner

*Primary Examiner*—John Barlow
*Assistant Examiner*—Shih-wen Hsieh
(74) *Attorney, Agent, or Firm*—Flory L. Martin

(57) ABSTRACT

A ganged inkjet printhead sealing system maintains inkjet printhead health in an inkjet printing mechanism during periods of printing inactivity. In multi-printhead printing mechanisms, separate caps seal against each of the printheads. The caps each have an outlet vent. The vents are all ganged together and fluidically coupled to a single, common pressure regulation chamber that isolates the environment adjacent the printhead nozzles from the external environment when the printheads are capped. A fluid in a U-shaped manometer tube, or an elastomeric bladder are used to isolate the pressure chamber environment. The bladder may be constructed as a thin-walled sheet, a spring-biased bag, or as a bellows. The pressure chamber volume changes to accommodate pressure spikes during the capping process, as well as environmental changes in temperature, elevation, barometric pressure, etc. An inkjet printing mechanism having such a ganged capping system, along with associated capping methods are also provided.

27 Claims, 6 Drawing Sheets

$P_0=P_A; V=V_0$
$P_A; T_A$
$\Delta h=0$
$+\Delta h$
$P_1 > P_A$
$V_1 > V_0$
$P_1; V_1$

GANGED INKJET PRINTHEAD CAPPING SYSTEM

FIELD OF THE INVENTION

The present invention relates generally to inkjet printing mechanisms, and more particularly to a ganged inkjet printhead capping system for sealing several inkjet printheads during periods of printing inactivity by coupling the printhead caps to a single, common pressure regulation chamber which accommodates for changes in altitude, barometric pressure, temperature and other environmental variations without depriving the printheads.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include an elastomeric capping system which hermetically seals the printhead nozzles from contaminants and drying. To facilitate priming, some printers have elastomeric priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible elastomeric wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper. Unfortunately, the combination of small nozzles and quick-drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality.

Thus, sealing the nozzles during periods of printing inactivity becomes even more important when using pigment-based inks, because the higher solids content contributes to the clogging problem more than earlier dye-based inks. When inkjet pens are not used during periods of printing inactivity, they are typically placed in a capping system to keep the nozzles from plugging up with dried ink. These ink plugs are caused by loss of water vapor from the printhead into the surrounding air. This loss of water vapor increases the viscosity of the ink in the nozzles until the ink becomes so thick or hard that it cannot be fired from the nozzles through energizing the associated resistor, such as in a spitting routine.

Black pens are believed to fail due to an increase ink viscosity. A slow loss of water vapor causes a thick sludge to be formed in the nozzle, which becomes so thick that the sludge cannot be evacuated by firing the associated resistor during spitting. Indeed, firing the resistor most likely creates a drying heat that actually hardens the sludge into a permanent plug. In actuality, there will most likely be a viscosity gradient through an ink plug, where the ink nearest the air interface has the highest viscosity, with the viscosity lowering toward the interior of the pen.

Color pens are believed to fail due to a hard crust being formed at the air-ink interface. The liquid behind this crusted surface has a higher viscosity than the ink stored in the reservoir, but the pen would probably fire if the hard crust was removed. Unfortunately, this hard crust still allows water to diffuse through the crust to the air surface, eventually leading to drying of the pen. This diffusion often causes a bearding phenomenon where an ink crystal grows out of the nozzle, similar to the way a salt crystal is formed through capillary pull and crystal deposits. Moreover, this water diffusion may yield vary hard plugs over the long term, such as on the order of months.

Thus far, all of the known production inkjet printers have used a diffusion path capping system. The cap has been typically implemented as an elastomeric portion that is pressed against the pen orifice plate during periods of printer inactivity. The objective of the elastomeric caps has been to control the interaction of the pen nozzles with the surrounding environment, primarily to reduce and preferably eliminate evaporation of the water from the ink composition. These elastomeric caps used diffusion paths and/or vent paths which allowed air exchange with the outside environment. These vent paths were required to regulate the pressure within the cap because any substantial increase or decrease in this pressure caused the pens to either drool (leak ink into the cap) or to deprime (ink retreating from the printhead firing chambers back into the reservoir). These abrupt pressure changes may be caused by the action of capping the pens, by changes in the temperature within the cap, by changes in the outside ambient pressure which cause a change in the mass of the air between the cap and the orifice plate, or by altitude changes due to reshipment.

For instance, the Hewlett-Packard Company's DeskJet® 850C model color inkjet printer employed an elastomeric, multi-ridged capping system to seal the pigment based black pen. A spring-biased sled supported both the black and color caps, and gently engaged the printheads to avoid depriming them. A vent system was required including an elastomeric vent plug and a labyrinth vent path under the sled to avoid inadvertent over-pressurizations or under-pressurizations, like barometric changes in the ambient pressure or from volume changes during the capping process. Other elastomeric capping systems using a labyrinth vent paths were first introduced in the Hewlett-Packard Company's DeskJet® 720C, 690C, 1000C and 2000C models of color inkjet printers.

Indeed, an ideal inkjet printhead capping system would maintain nozzle ink viscosity within a specified range over an incredibly long period of time, on the order of half a year, for instance. Specifically, such an ideal capping system would accomplish several objectives, including: (1) maintain a desired humidity level at the nozzles; (2) not allow the exchange of air inside the capping chamber with air from the external environment; (3) maintain a safe pressure range at the nozzles, allowing for increases or decreases in pressure as needed; and (4) accommodate ink drooling from the pen, whenever it occurs.

Thus, it would be desirable to find new ways of sealing a group of inkjet printheads which preserves pen health over longer periods of printer inactivity than the earlier capping systems.

SUMMARY OF THE INVENTION

According to one aspect of the present invention, a ganged capping system is provided for sealing nozzles of plural (more than one) inkjet printheads in an inkjet printing mechanism during periods of printing inactivity. The ganged capping system includes a cap sled which is moveable between a sealing position and a rest position. Plural caps are each supported by the sled to engage an associated one of the plural printheads when the sled is in the sealing position to form a sealing chamber surrounding the nozzles between each cap and each printhead. The ganged capping system a pressure chamber structure with an interior that defines a pressure chamber. The pressure chamber is fluidically coupled to each sealing chamber to isolate the sealing chambers from external environmental conditions when the cap sled is in the sealing position.

According to a further aspect of the present invention, a method of sealing plural inkjet printheads in an inkjet printing mechanism during periods of inactivity is provided. The method includes the step of sealing each of said plural inkjet printheads with an associated one of plural printhead caps to form a sealing chamber surrounding the nozzles between each cap and each printhead. In a coupling step, each sealing chamber is coupled to a pressure chamber defined by an interior of a pressure chamber structure, with the pressure chamber having a neutral volume before the sealing step. The method includes the step of changing the volume of the pressure chamber during said sealing step and thereafter in response to changing ambient environmental conditions external to the pressure chamber structure.

According to yet a further aspect of the present invention, an inkjet printing mechanism may be provided with a ganged capping system as described above.

An overall goal of the present invention is to provide a printhead service station for an inkjet printing mechanism that facilitates printing of sharp vivid images, particularly when using fast drying pigment based inks, co-precipitating inks, dye based inks, or ultra-fast drying inks, by maintaining pen health during long periods of printing inactivity, such as on the order of half a year.

Another goal of the present invention is to provide an inkjet printhead sealing system which maintains a desired humidity range and pressure range at the pen orifice plate, while also accommodating for inadvertent pen drooling episodes, all without allowing any exchange of the air in the cap with the ambient air.

A further goal of the present invention is to provide a method of sealing a group of inkjet printheads which preserves printhead health and provides consumers with a reliable, robust printing unit that consistently prints high quality images, even after extended periods of printer inactivity.

DETAILED DESCRIPTION OF THE PREFERRED EMBODIMENTS

Figure 1:
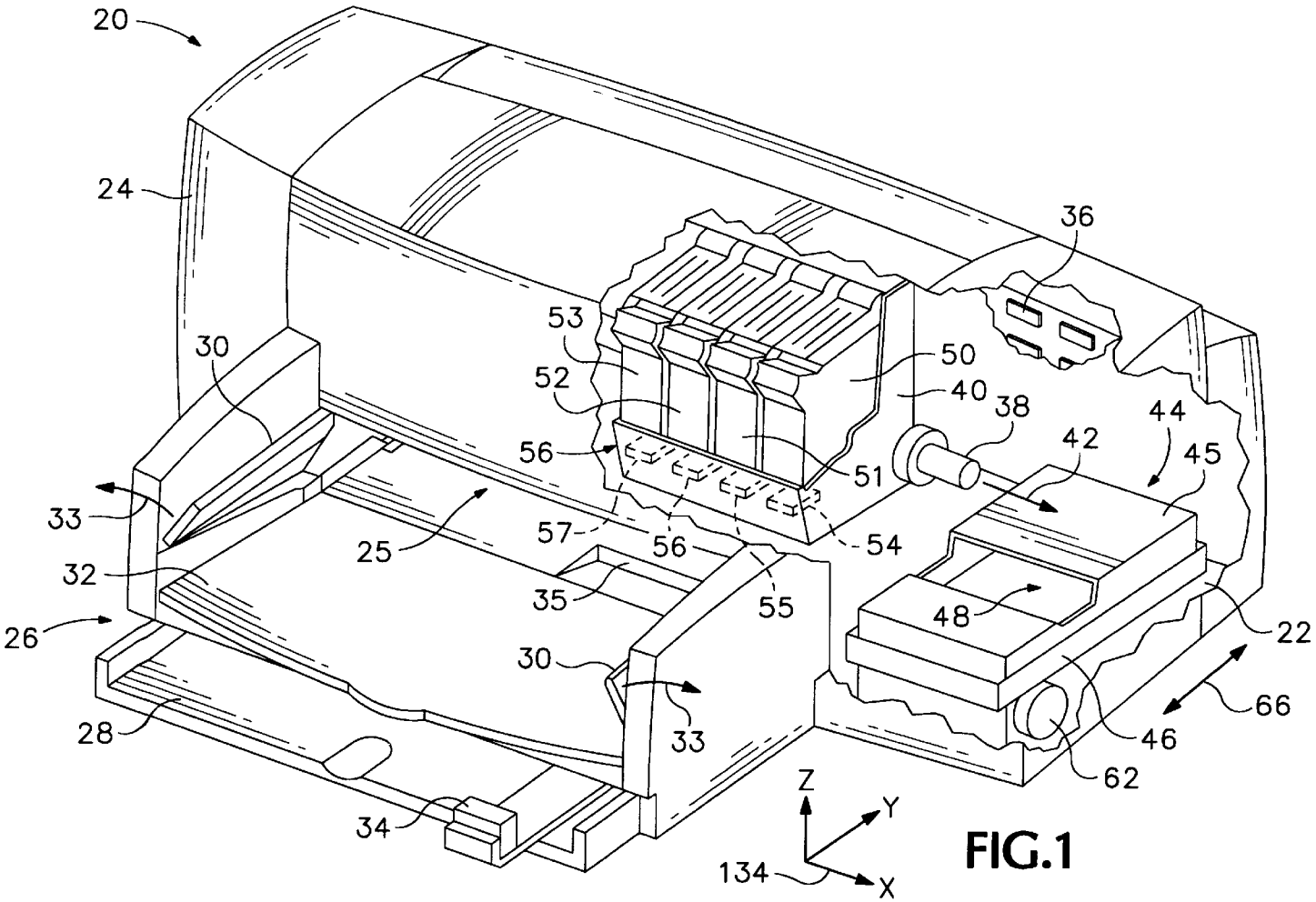
FIG. 1 is a fragmented, partially schematic, perspective view of one form of an inkjet printing mechanism including one form of a ganged inkjet printhead sealing system of the present invention for maintaining inkjet printhead health during periods of printing inactivity.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a print zone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the print zone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the print zone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical, magnetic, microwave, or other type of encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below. In FIG. 1, a printhead servicing entrance portal 48 of the service station is shown as being defined by the service station frame 46.

In the print zone 25, the media sheet receives ink from an inkjet cartridge, such as a black ink cartridge 50 and/or several color ink cartridges 51, 52 and 53. The cartridges 50–53 are also often called "pens" by those in the art. The illustrated color pens 51–53 dispense three dye based ink colors, such as cyan, yellow and magenta, although in other embodiments, a single tri-color pen may be used having separate internal reservoirs containing each color. While the color pens 51–53 may contain pigment based inks, for the purposes of illustration, pens 51–53 contain dye-based inks. The black ink pen 50 is illustrated herein as containing a pigment based ink. It is apparent that other types of inks may also be used in pens 50–53, such as thermoplastic, wax or paraffin based inks, as well as hybrid or composite inks having both dye and pigment characteristics.

The illustrated pens 50–53 each include reservoirs for storing a supply of ink. The pens 50, 51, 52 and 53 each have printheads 54, 55, 56 and 57, respectively, each of which have an orifice plate with a plurality of nozzles formed therethrough in a manner well known to those skilled in the art. The illustrated printheads 54–57 are thermal inkjet printheads, although other types of printheads may be used, such as piezoelectric printheads. The printheads 54–57 typically include substrate layer having a plurality of resistors which are associated with the nozzles. Upon energizing a selected resistor, a bubble of gas is formed to eject a droplet of ink from the nozzle and onto media in the print zone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50–53 to the printheads 54–57.

Ganged Inkjet Printhead Capping System

Figures 2, 3:
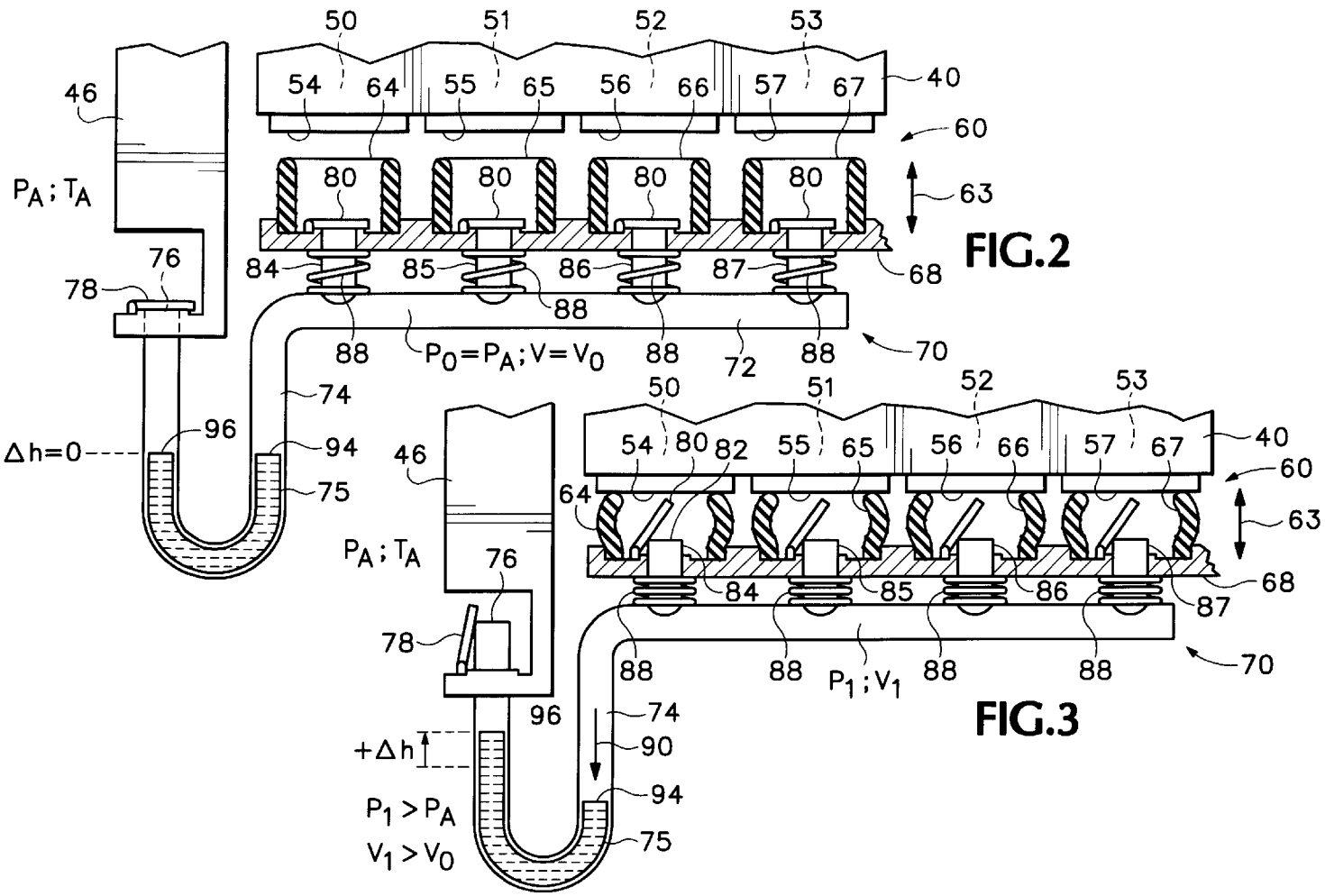
FIG. 2 is a schematic side elevational view of one form of a first embodiment of a ganged inkjet printhead sealing system of FIG. 1, including a ganged cap pressure chamber solution using a U-tube differential manometer, shown prior to capping.
FIG. 3 is a schematic side elevational view of the ganged inkjet printhead sealing system of FIGS. 1 and 2, shown in a capping position, with an increase in cap pressure from the free uncapped state of FIG. 2, with the increase in cap pressure ($+\Delta h$) being caused either by the pressure increase of the capping operation, by a decrease in ambient pressure ($-P_A$), or by an increase in temperature ($+T$).
Figure 4:
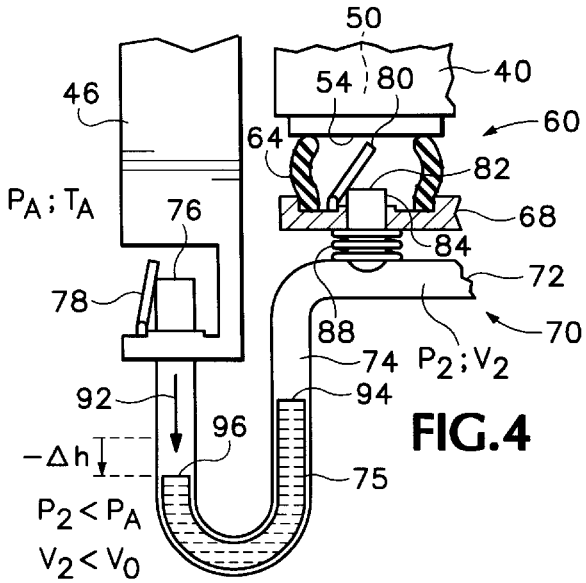
FIG. 4 is a schematic side elevational view of a portion of the ganged inkjet printhead sealing system of FIGS. 1–3, shown in a capping position, with a decrease in cap pressure from the free uncapped state of FIG. 2, with the decrease in cap pressure ($-\Delta h$) being caused by a decrease in temperature ($-T$), or by an increase in the ambient pressure ($+P_A$).

FIGS. 2–4 illustrate a first embodiment of a ganged capping system 60 for inkjet printhead sealing, constructed in accordance with the present invention as a portion of the service station 45. To service each of the printheads 54–57 of the pens 50–53, the service station 45 includes a stepper motor and pinion gear assembly 62 coupled to move the capping system 60 between the free, uncapped state of FIG. 2 and the capped state of FIGS. 3 and 4, as indicated by arrow 63. It is apparent that a variety of different mechanisms may be used to move the capping system 60 between a capped state and an uncapped state, such as the worm gear and rack gear assembly shown in U.S. Pat. No. 5,455,609 (presently assigned to the Hewlett-Packard Company), or using ramped systems, translationally moving systems, rotary systems, or a combination systems having both rotary and translational motion.

Four elastomeric printhead caps 64, 65, 66 and 67 are supported by a cap sled 68 to seal printheads 54, 55, 56 and 57, respectively. Preferably, the caps 64–67 are constructed of a resilient, non-abrasive, elastomeric material, such as nitrile rubber, silicone, or more preferably of an ethylene polypropylene diene monomer (EPDM), as well as other comparable materials known in the art. The banged capping system 60 includes a pressure chamber 70, which has a manifold portion 72 coupled to a U-shaped differential manometer tube 74. The manometer tube 74 is filled with a fluid 75, which resides in the bottom portion of the U-shaped tube 74. The manometer fluid 75 preferably has a low vapor pressure and a low water permeability (when using water-based inks), such as an oil-based liquid. The U-shaped tube 74 is slidably mounted to a portion of the service station frame 46 (compare the views of FIG. 2 with FIGS. 3 and 4). When in the uncapped position, an open end 76 of the U-shaped tube 74 is sealed by a cover member, such as a pivoting door 78. In the capped position of FIGS. 3 and 4, the opened end 76 of the manometer tube 74 pushes open the pivoting door 78, to expose the free end 76 of the tube to atmospheric pressure conditions, here, labeled as $P_A$ with the ambient temperature labeled as $T_A$.

Similarly, each of the caps 64–67 has a pivoting cover 80, which in the free uncapped state of FIG. 2 are biased to cover an opening 82 of a stand-off pipe, such as stand-off pipes 84, 85, 86 and 87 of the respective caps 64, 65, 66 and 67. Each of these stand-off pipes 84–87 are fluidically coupled to the manifold portion 72 of the pressure chamber 70. Preferably, the manometer tube is sized to open its cover 78 before the stand-off pipe covers 80 open to allow the manometer fluid 75 to accommodate the pressure increase experienced during the capping process. This step of opening the manometer port 76 before opening covers 80 can be seen by comparing the relative heights of the manometer 74 and the stand-off pipes 84–87 in FIG. 3. A biasing device, such as a coil spring 88, surrounds each of the stand-off pipes 84–87 to bias the pressure chamber 70 away from the cap sled 68, and into a position where the covers 80 seal each of the stand-off pipes 84–87 in the uncapped state (FIG. 2). Preferably, all of the covers 78 and 80 are spring biased toward the closed position of the uncapped state. It is apparent that a variety of different cover mechanisms 78–80 may be used to seal the free end of the manometer tube 76 and the free ends 82 of the stand-off pipes 84–87. Now the components of the pressure chamber ganged cap system 60 have been described, a description of system operation is in order.

Ganging all of the caps 64–67 together then coupling them to a single pressure chamber 70 allows control of the pen environment by one external system, here the pressure chamber 70. This pressure chamber 70 allows printheads 54–57 to be completely isolated from the external environment though the use of the manometer fluid 75, which advantageously brings water vapor loss within the pens 50–53 to a minimum. It is apparent that some water vapor may still be lost based upon the quality of the pen-to-cap interface at the orifice plate, as well as any other potential leak points within the system. Indeed, the illustrated pressure chamber 70 works in a manner similar to the conventional U-tube manometer, with the reservoir of liquid 75 serving to accommodate changes in pressure. Here, rather than using the U-shaped tube 74 to measure pressure changes, the manometer tube 74 is instead used to regulate pressure changes, as shown from a comparison of FIGS. 2, 3 and 4. Movement of the manometer liquid 75 within tube 74 accommodates changes in pressure by acting as a liquid bellows. Since the output side 76 of this liquid bellows is subjected to ambient air at ambient pressure $P_A$ and ambient temperature $T_A$, the pressure chamber system 70 is constantly trying to equalize pressure within the caps 64–67 according to the following equations:

$$P_F=(\gamma_M)(\Delta h)-\gamma$$

where: $P_F$=Final Pressure;

$\gamma_M$=Specific Weight of the Manometer Fluid; and $\gamma$=Specific Weight of Air.

Thus, in FIG. 3 we see an increase in the pressure inside chamber 70, with the fluid 75 in the manometer tube 74 being displaced as indicated by arrow 90 to show an increase in the height of the fluid 75 toward outlet 76, indicated as $+\Delta h$. This increase in the pressure within chamber 70 may be caused by the initial force of capping the pens 50–53, or by an increase in temperature within the chamber 70, or by a decrease in the ambient pressure $P_A$. The opposite situation is shown in FIG. 4, where there is a decrease in pressure inside chamber 70, as indicated by arrow 92. showing the downward motion of the manometer fluid 75 away from the outlet 76, with this change in fluid height indicated as $-\Delta h$. This decrease in the pressure within chamber 70 may be caused by a decrease in temperature, or an increase in the ambient pressure $P_A$.

Similarly, barometric changes or changes in altitude may also affect the pressure in chamber 70, resulting in shifting of the manometer fluid 75, such as illustrated by FIGS. 3 and 4. That is, an increase in elevation would typically be registered as a decrease in the ambient pressure, resulting in manometer fluid motion shown in FIG. 3. Here, the letter V indicates the air volume between the orifice plates, the printhead caps, and an upper surface 94 of the manometer liquid 75. The initial pressure $P_0$ within the chamber 70 is at ambient pressure when uncapped, as shown in FIG. 2

($P_0$=$P_A$). In FIG. 3 we see the pressure $P_1$ within chamber 70 is greater than the new ambient pressure, and the resulting new air volume $V_1$ within chamber 70 has increased over the initial air volume $V_0$ as surface 94 of the manometer fluid 75 has dropped, indicated on the metering side as a +Δh rise in the height of the fluid 75 at surface 96. A decrease in elevation or a rise in the barometric pressure yields the situation shown in FIG. 4. In FIG. 4 the pressure $P_2$ inside chamber 70 is lower than the new ambient pressure $P_A$, and the resulting new air volume $V_2$ inside chamber 70 is less than the initial volume $V_0$ as surface 94 of the manometer fluid 75 has risen, indicated on the metering side as a −Δh in the change of the height of the fluid 75 at surface 96.

Figure 5:
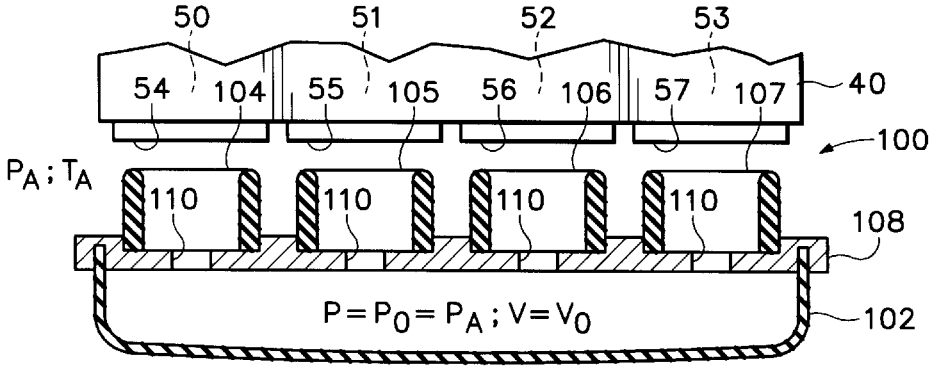
FIG. 5 is a schematic side elevational view of one form of a second embodiment of a ganged inkjet printhead sealing system of FIG. 1, including a thin-walled flexible pressure chamber solution, shown prior to capping.
Figure 6:
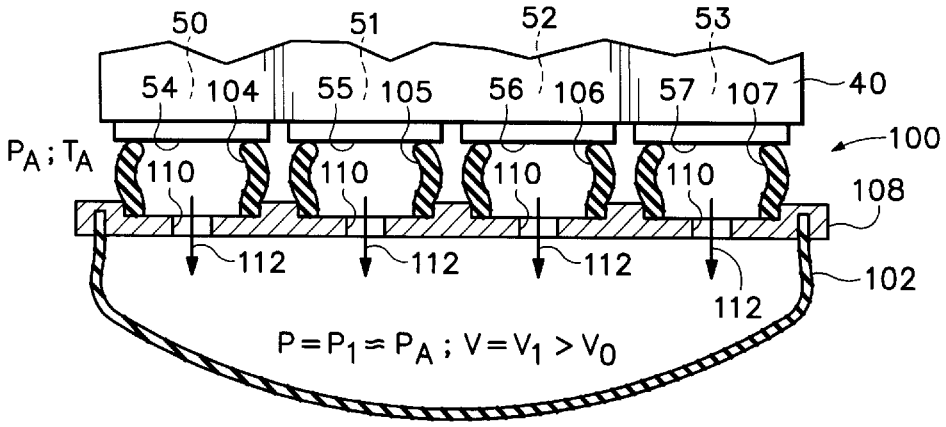
FIG. 6 is a schematic side elevational view of the ganged inkjet printhead sealing system of FIG. 5, shown in a capping position, with an increase in chamber volume ($V_1$) from the volume of the free uncapped volume ($V_0$) of FIG. 5, with the increase in chamber volume being caused either by the pressure increase of the capping operation, by an increase in temperature ($+T$), or by a decrease in ambient pressure ($-P_A$).
Figure 7:
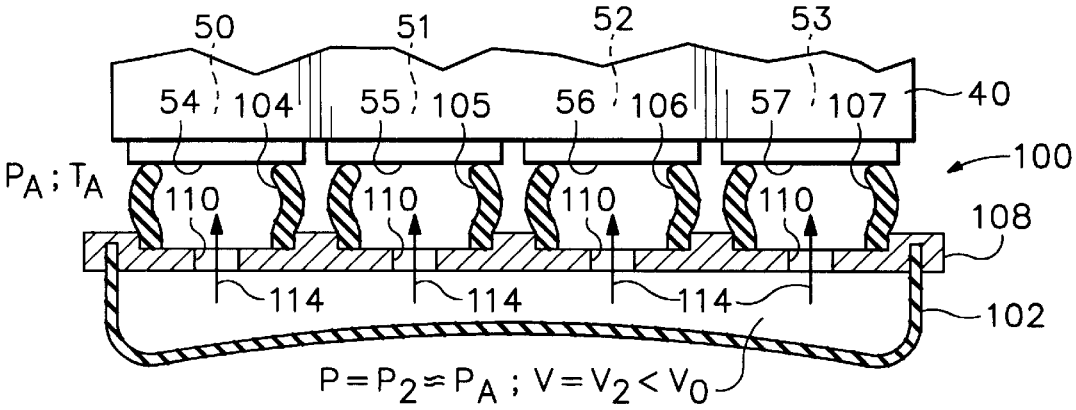
FIG. 7 is a schematic side elevational view of the ganged inkjet printhead sealing system of FIGS. 5 and 6, shown in a capping position, with a decrease in chamber volume ($V_2$) from the free uncapped volume of FIG. 5, with the decrease in chamber volume being caused by a decrease in temperature ($-T$), or an increase in the ambient pressure ($+P_A$).

In FIGS. 5–7, a second embodiment of a ganged capping system 100, constructed in accordance with the present invention, is shown as including a thin wall pressure chamber or bladder 102. The ganged capping system 100 has four elastomeric caps 104, 105, 106 and 107, each situated to seal the printheads 54, 55, 56 and 57, respectively. Each of the caps 104–107 are mounted to a cap sled 108 to be in fluid communication with the interior of the pressure chamber 102 through a series of openings, such as openings 110 defined by the cap sled 108. Once again, any type of conventional mechanism may be used to move the cap sled 108 between the uncapped position of FIG. 5 and the capped position of FIGS. 6 and 7.

In FIG. 6, we see an increase in the volume of the thin walled pressure chamber 102, which may be caused by the initial capping operation, by an increase in the ambient temperature, or by a decrease in the ambient pressure $P_A$, relative to the new air pressure $P_1$ within the bladder 102. For instance, upon initial capping, air is forced out of the sealing chambers defined between the caps 104–107 and the respective printheads 54–57, as indicated by arrows 112, with the air escaping into the pressure chamber 102. The resulting new chamber volume $V_1$ is greater than the initial volume $V_0$ ($V_1$>$V_0$). Thus, the condition shown in FIG. 6 is similar to that shown in FIG. 3. The situation shown in FIG. 7 is similar to the situation in FIG. 4. In FIG. 7, the new volume $V_2$ inside the pressure chamber 102 has decreased from the initial volume $V_0$ ($V_2$<$V_0$). Air escapes from the pressure chamber 102 through the openings 110 back into the cap chambers, as indicated by arrows 114 in FIG. 7. This decrease in the volume of the pressure chamber 102 may be caused by a decrease in the ambient temperature, or an increase in the ambient pressure.

Indeed, the thin walled pressure chamber 102 of FIGS. 5–7 may be preferred over the manometer solution of service station 60 in FIGS. 2–4 because no additional sealing liquid 75 is required to maintain pressure within the chamber 102. By ganging together the four caps 104–107 at pressure chamber 102, the capping system 100 advantageously allows the overall volume of the pressure chamber 102 to be larger than required for a single cap, thus allowing more wall surface area of the chamber 102 to be available for expansion (FIG. 6) and contraction (FIG. 7). For instance, an analysis of a typical temperature excursion for normal operation of an inkjet printer 20 is on the order of 10° C. to 35° C. This typical temperature excursion results in a volume change of approximately 9% to maintain a constant pressure within the sealing chambers defined between the respective caps 104–107 and printheads 54–57. Furthermore, by increasing the surface area of the pressure chamber 102, the overall flexing of the wall is minimized, resulting in a more robust solution with greater manufacturing tolerances available than for the manometer capping system 60. Additionally, the thin walled system 100 has no need for the stand pipes 84–87, covers 78–80, and springs 88 of system 60, resulting in more economical part costs and less labor time to assemble capping system 100. Moreover, through standard manufacturing techniques, the pressure chamber wall 102 may be insert molded to the sled 108 at the same time that caps 104–107 are insert molded to sled 108, resulting in a more economically assembled capping unit 100. In this embodiment, the governing equation for the performance of the thin walled pressure chamber 102 is as follows:

$$(P_1)(V_1+T_1)=(P_2)(V_2+T_2)$$

assuming for theoretical purposes that the pressure chamber 102 has negligible stiffness.

Figure 8:
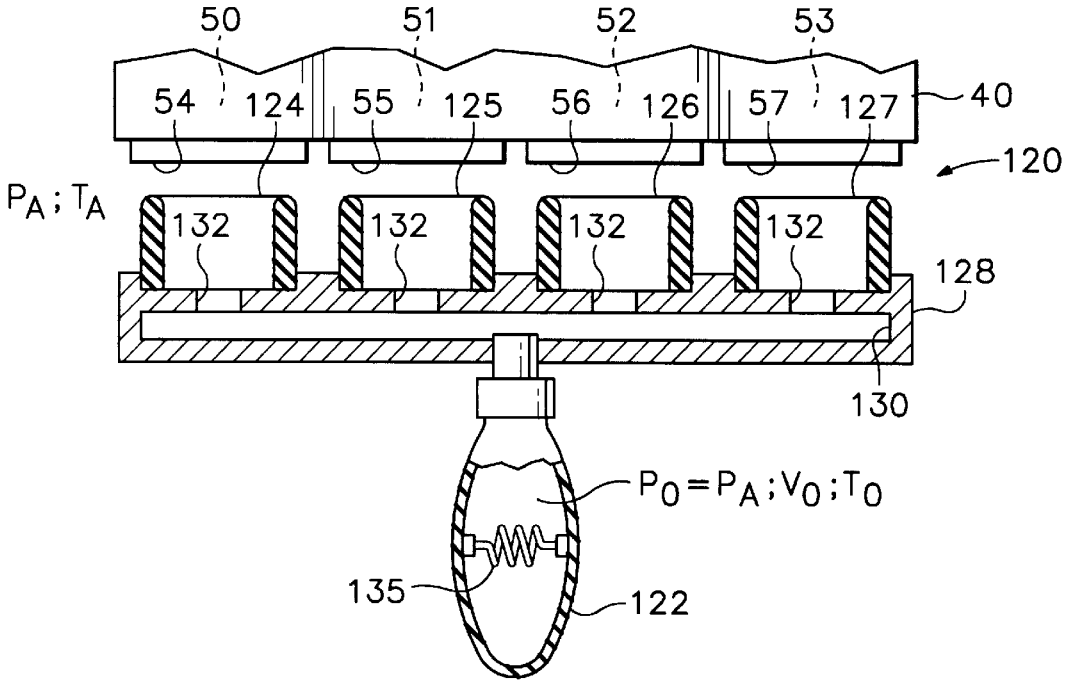
FIG. 8 is a schematic side elevational view of one form of a third embodiment of a ganged inkjet printhead sealing system of FIG. 1, including a variable pressure bag solution, shown prior to capping.
Figure 9:
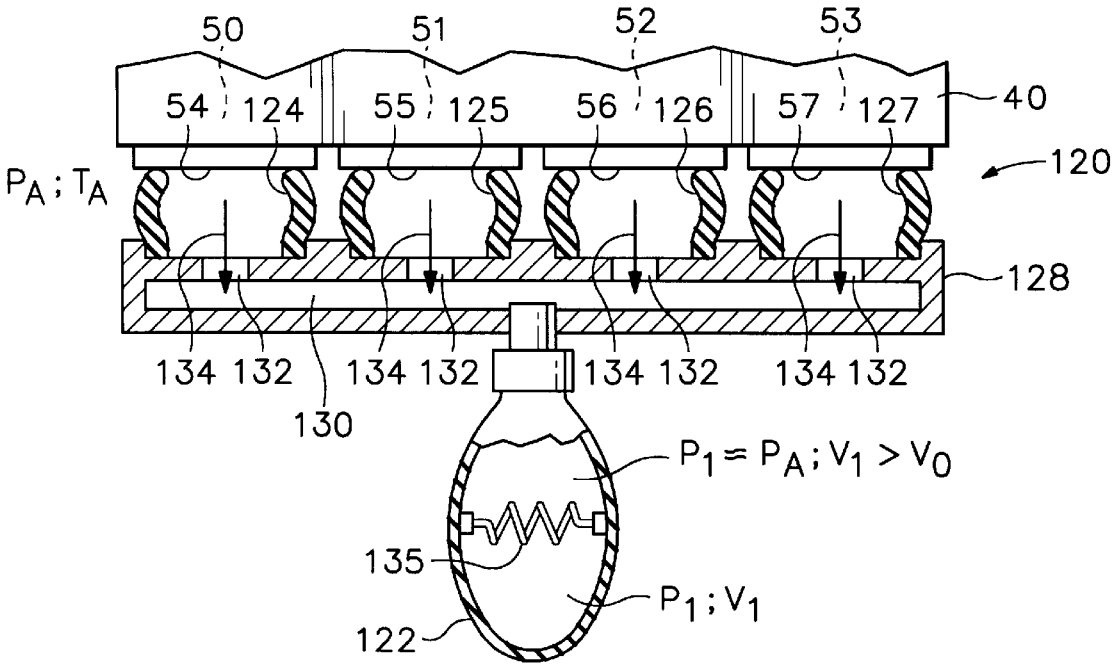
FIG. 9 is a schematic side elevational view of the ganged inkjet printhead sealing system of FIG. 8, shown in a capping position, with an increase in bag volume ($V_1$) from the volume of the free uncapped volume ($V_0$) of FIG. 8, with the increase in bag volume being caused either by the pressure increase of the capping operation, by an increase in temperature ($+T$), or by a decrease in ambient pressure ($-P_A$).
Figure 10:
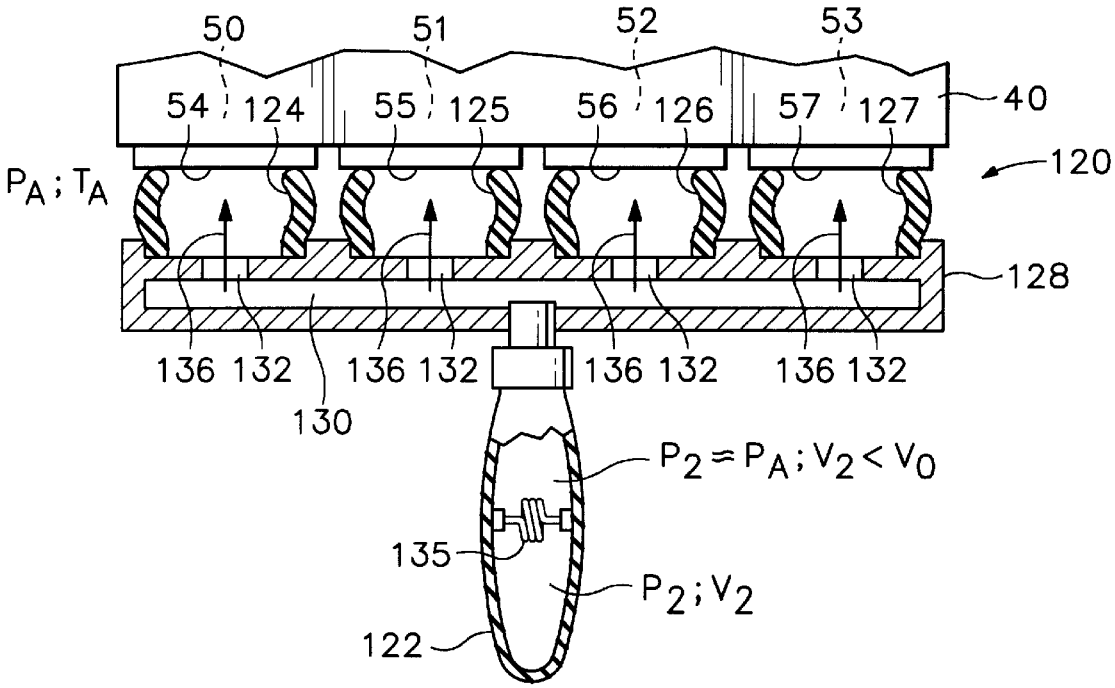
FIG. 10 is a schematic side elevational view of the ganged inkjet printhead sealing system of FIGS. 8 and 9, shown in a capping position, with a decrease in bag volume ($V_2$) from the free uncapped volume of FIG. 8, with the decrease in bag volume being caused by a decrease in temperature (−T), or an increase in the ambient pressure ($+P_A$).

In FIGS. 8–10 a third embodiment of a ganged capping system 120 is shown as including a variable volume pressure bag 122. A series of four caps 124, 125, 126 and 127 of an elastomeric material are supported by a sled 128, which may be moved between a capped position and an uncapped position in the same manner as described above with respect to the manometer ganged capping system 60. The cap sled 128 defines an auxiliary chamber or a subchamber 130, which is coupled to the inner region of each of the caps 124–127 by openings 132, which are defined by sled 128. The interior of subchamber 130 is in fluidic communication with the interior of the pressure bag 122, to allow for the free flow of air from the sealing chambers defined between the caps 124–127 and the printheads 54–57 when sealed. For instance, when initially capping the printheads 54–57, air escapes from the sealing chambers through openings 132 and into subchamber 130, as indicated by arrows 134, and thereafter into the interior of the pressure bag 122, as shown in FIG. 9. Here, we see the new volume $V_1$ of the bag 122 has increased beyond the initial volume $V_0$, which was shown in FIG. 8. Such an increase in the volume $V_1$ of the pressure bag 122 may be caused by the initial pressure spike from capping the printheads, an increase in temperature, or a decrease in the ambient pressure.

To maintain the initial volume $V_0$ of the pressure bag 122 in a fixed state, an optional biasing spring 135 may be used, shown here as being placed inside the pressure bag 122, with the spring being shown in a neutral state in FIG. 8. The pressure increase caused by air 134 escaping from the sealing chambers causes the spring 135 to expand, as shown in FIG. 9, as the volume $V_1$ inside the pressure bag 122 increases. Thus, it is apparent that the relative degree of expansion of the pressure bag 122 may be dictated by selection of the spring 135. Moreover, while an internal spring 135 is shown, it is apparent to those skilled in the art that an external spring or other biasing means may be used to hold the volume of the bag 122 at an initial fixed state.

FIG. 10 shows the resulting contraction of the pressure bag 122, as air moves from the subchamber 130 into the sealing chambers defined between caps 124–127 and the respective printheads 54–57, with this airflow being indicated by arrows 136. The situation of FIG. 10 may result from a decrease in the ambient temperature or an increase in the ambient pressure, as described above with respect to the situations of FIGS. 4 and 7. In FIG. 10, the air volume $V_2$ of the pressure bag has decreased below the ambient volume $V_0$ ($V_2$<$V_0$), which has caused the spring 135 to be compressed from the initial state shown in FIG. 8. Once again, by selection of the spring 135 the rate of airflow 136 through the openings 132 may be regulated. The governing equations for this embodiment are as follows:

$$PV \div T = C$$

$$PA = K(X - X_0)$$

$$V = V_0 + (A)(X - X_0)$$

where: C is a constant value;

K is the spring constant of spring 135;

$X_0$ is the starting length of the spring 135;

X is the final length of the spring 135; and

A may be a linear or nonlinear equation depending upon the geometry chosen for the spring bag 122.

Figure 11:
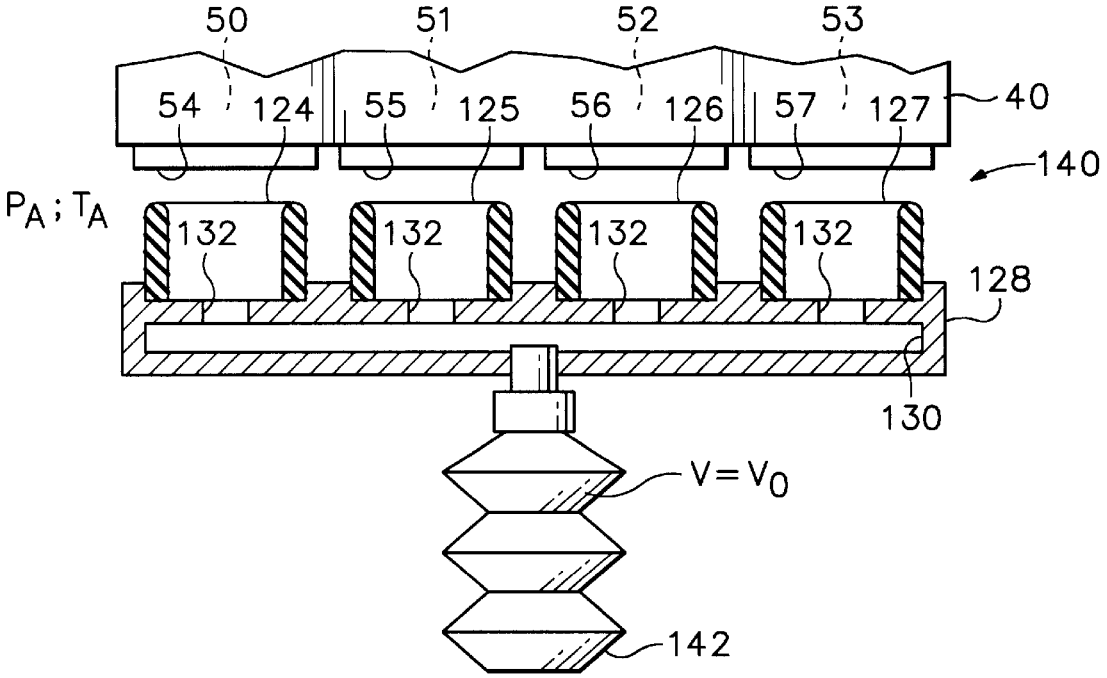
FIG. 11 is a schematic side elevational view of one form of a fourth embodiment of a ganged inkjet printhead sealing system of FIG. 1, including a compression bellows solution, shown prior to capping.
Figure 12:
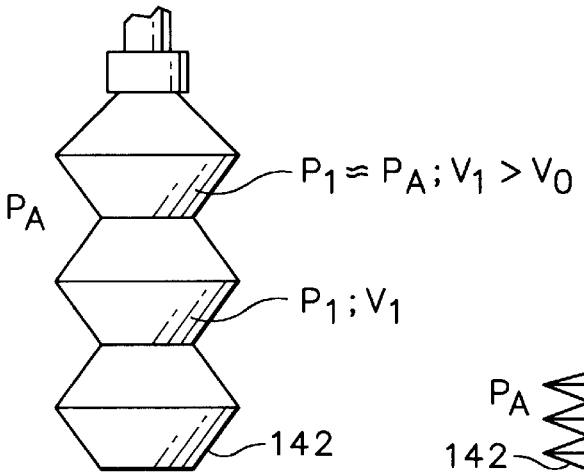
FIG. 12 is a schematic side elevational view of the ganged inkjet printhead sealing system of FIG. 11, showing the bellows when capped, with an increase in bellows volume ($V_1$) from the volume of the free uncapped volume ($V_0$) of FIG. 11, with the increase in bellows volume being caused either by the pressure increase of the capping operation, by an increase in temperature (+T), or by a decrease in ambient pressure ($-P_A$).
Figure 13:
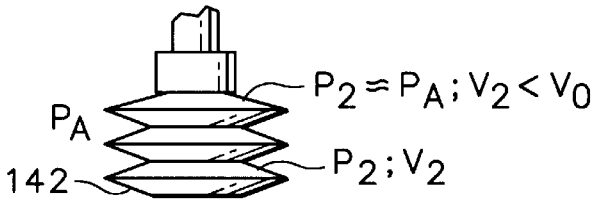
FIG. 13 is a schematic side elevational view of the ganged inkjet printhead sealing system of FIGS. 11 and 12, showing the bellows when capped, with a decrease in bellows volume ($V_2$) from the free uncapped volume of FIG. 11, with the decrease in bellows volume being caused by a decrease in temperature (−T), or an increase in the ambient pressure ($+P_A$).

FIGS. 11–13 illustrate a fourth embodiment of a ganged capping system 140, constructed in accordance with the present invention, using an expanding bellows member 142 instead of the pressure bag 122. The capping sled 128 and the four caps 124–127 remain substantially the same as described above with respect to the variable pressure bag capping system 120 of FIGS. 8–10. In FIG. 11, the bellows member 142 is shown in an initial relaxed state, with a spring force provided by the construction of the bellows being used to hold the volume in the initial $V_0$ shape as shown. The spring nature of the bellows 142 replaces the internal coil spring 135 described above with respect to the embodiment of FIGS. 8–10.

FIG. 12 shows the expansion of the bellows 142, which may occur for the same reasons as described above with respect to FIG. 9, caused by air escaping from the sealing chambers, through the openings 132, and then into the bellows 142. In FIG. 12 the new bellows volume $V_1$ is greater than the initial volume $V_0$ of FIG. 11 ($V_1 > V_0$). This increase in the volume $V_1$ may be caused by an increase in temperature, or a decrease in the ambient pressure. In contrast, FIG. 13 shows the collapse of the bellows 142, which occurs for the same reasons as the situation of FIG. 10, where air is drawn from the internal portion of bellows 142 in the directions of arrows 136 and back into the sealing chambers. This contraction of bellows 142 shown in FIG. 13 may be caused by an increase in the ambient pressure, or a decrease in the ambient temperature.

By choosing a relatively soft material for the construction of bellows 142, the ganged capping system 140 allows the pressure chamber 142 to expand and contract linearly, as shown from a comparison of FIGS. 11–13. Thus, a small spring value may be created by the folded features of the bellows chamber 142, which may be constructed in a manner very similar to that used to construct a rubber boot which covers shocks or drive shafts on a car. In this embodiment, the system performance is dictated by the following equation:

$$F = (K)(X)$$

where: F=Force of Expansion or Contraction;

K=Spring Constant of the Bellows; and

X=Distance of Deflection of the Bellows.

Conclusion

Thus, there are a variety of advantages that can be realized using the ganged capping system 60, 100, 120, 140. For instance, all of the capping solutions illustrated here focus on the goal of separating the external environment from the environment near the nozzles. If the conditions of the environment within the sealing chamber defined between the elastomeric caps and the printheads 54–57 is controlled, sealing of the printheads 54–57 using these ganged capping systems may approach the excellent performance of the adhesive tape which is used to seal the printheads during shipping, sale and storage.

Another advantage of the ganged capping systems 60, 100, 120 and 140 is the ability of each of these systems to handle any ink drooled from the pens. For instance, any ink drooled inside the interior of the caps 64–67 by pens 50–53 is drained into the stand-off pipes 84–87 during the uncapping process as the springs 88 expand and the level of the openings of the stand-off pipes 84–87 falls to the rest position of FIG. 2. The thin walled pressure chamber 102, the variable bag 122, and the bellows 142 may each serve as receptacles for collection of drooled ink.

As mentioned above, one of the primary advantages of the ganged capping systems 60, 100, 120 and 140 is the elimination of air exchange between the sealing chambers adjacent the orifice plates 54–57 and the outside environment, without subjecting the pen nozzles to undesirable pressure changes. Once these closed ganged capping systems 60, 100, 120 and 140 reach a humidity equilibrium, there is very little additional water vapor loss from the pens 50–53. While a variety of different types of elastomers may be used to construct the pressure chamber structures 102, 122 and 142, preferably they are constructed of an ink compatible material which may be of the same material or family of material as the cap lip structures 64–67, 104–107, 124–127. Ink compatibility is particularly desirable for the pressure chamber structures 102, 122 and 142 when they are used to collect ink drooled from the pens.

Another advantage is realized by connecting all four of the pens 50–53 to a single, common regulating system 74, 102, 122, 142. Use of the ganged capping system 60, 100. 120, 140 reduces the total volume of air that each pen is subjected to nearly one fourth of that experienced using the earlier capping systems. The total volume change of the air within the ganged capping system used to service all four of the pens 50–53 is equivalent to the volume required to service a single pen in the earlier capping systems. Another advantage of the ganged capping system 60, 100, 120, 140 is that all of the caps 64–67, 104–107, 124–127 may be constructed with a single piece of elastomer, rather than the separate caps shown in the drawing figures.

Additionally, it is apparent that the illustrated ganged capping systems 60, 100, 120, 140 are described here by way of example, and that the concepts illustrated may be applied in a variety of different implementations, without departing from these inventive concepts. For example, the ganged capping systems 60, 100, 120 and 140 illustrate improvements in manufacturing efficiency over the earlier capping systems. These improvements are primarily realized in the reduction of the number of parts because only a single pressure regulation chamber is used to service all four of the pens 50–53, as opposed to the earlier capping systems having four separate chambers which each required additional assembly steps and parts for their construction.

Thus, the ganged capping systems 60, 100, 120 and 140 result not only in a more economical inkjet printer 20, but also an inkjet printer which is more robust for consumers, and which may be left for extended periods of printing inactivity, while still maintaining excellent pen health.

We claim:

1. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position; and a pressure regulating device coupled to isolate the pressure chamber from said external environmental conditions; wherein said pressure regulating device comprises:

a hollow tubular structure coupled to the pressure chamber, with the tubular structure having an ambient port at ambient external environmental conditions when the cap sled is in the sealing position; and a liquid housed within the hollow tubular structure between the pressure chamber and the ambient port.

2. A ganged capping system according to claim 1 wherein the hollow tubular structure comprises a U-shaped tube.

3. A ganged capping system according to claim 1 further including a cover member biased to cover the ambient port when the sled is in the rest position and to open the ambient port when the sled is in the sealing position.

4. A ganged capping system according to claim 1 further including a manifold which fluidically couples each of the sealing chambers to the pressure chamber.

5. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position, wherein the pressure chamber structure has plural inlet members slideably coupled to the sled to extend therethrough into an associated one of the sealing chambers to fluidically couple each sealing chamber to the pressure chamber when the sled is in the sealing position; and a biasing member which biases the sled away from the pressure chamber structure when the sled is in the rest position.

6. A ganged capping system according to claim 5:

wherein each plural inlet member has a cap port which extends into said associated sealing chamber when the sled is in the sealing position; and further including plural cover members each biased to cover an associated cap port when the sled is in the rest position and to open said associated cap port when the sled is in the sealing position.

7. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position;

a pressure regulating device comprising a hollow tubular structure coupled to the pressure chamber, with the tubular structure having an ambient port at ambient external environmental conditions when the cap sled is in the sealing position, and a liquid housed within the hollow tubular structure between the pressure chamber and the ambient port; and a cover member biased to cover the ambient port when the sled is in the rest position and to open the ambient port when the sled is in the sealing position.

8. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead; and a pressure chamber structure having an interior defining a pressure chamber which is fluidically coupled to each sealing chamber to isolate the sealing chambers from external environmental conditions when the cap sled is in the sealing position, wherein the pressure chamber structure comprises a bladder member which is expandable and collapsible;

wherein the sled defines plural ports therethrough each associated with one of said plural caps to fluidically couple each sealing chamber with the bladder member.

9. A ganged capping system according to claim 8 wherein the bladder member is of a thin-walled elastomeric material supported by the sled to surround said plural ports.

10. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position, wherein the pressure chamber structure comprises a bladder member which is expandable and collapsible; and a biasing member supported by the bladder member to bias the bladder member to a neutral state, wherein when the sled is in the sealing position, the biasing member expands when the bladder member expands and the biasing member contracts when the bladder member collapses.

11. A ganged capping system according to claim 10:

wherein the sled defines plural ports therethrough to each sealing chamber; and further including an auxiliary chamber which fluidically couples said plural ports extending through the sled to the pressure chamber of the bladder member.

12. A ganged capping system according to claim 10 wherein the biasing member is supported by the bladder member inside the pressure chamber.

13. A ganged capping system according to claim 12 wherein the biasing member comprises a coil spring.

14. A ganged capping system for sealing nozzles of plural inkjet printheads in an inkjet printing mechanism during periods of printing inactivity, comprising:

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position, wherein the pressure chamber structure comprises a bellows member which is expandable and collapsible;

wherein the sled defines plural ports therethrough to each sealing chamber; and an auxiliary chamber which fluidically couples said plural ports extending through the sled to the pressure chamber of the bellows member.

15. A method of sealing nozzles of plural inkjet printheads in an inkjet printing mechanism during periods of printing inactivity, comprising:

sealing each of said plural inkjet printheads with an associated one of plural printhead caps to form a sealing chamber surrounding the nozzles between each cap and each printhead;

coupling each sealing chamber to a pressure chamber defined by an interior of a pressure chamber structure, with the pressure chamber having a neutral volume before the sealing step; and changing the volume of the pressure chamber during said sealing and thereafter in response to changing ambient environmental conditions external to the pressure chamber structure;

wherein said sealing comprises moving a sled which supports each of the plural caps from a rest position to a sealing position; and wherein said coupling comprises joining each sealing chamber to the pressure chamber through plural ports defined by the sled to extend therethrough.

16. A method of sealing nozzles of plural inkjet prints in an inkjet printing mechanism during periods of printing inactivity, comprising:

sealing each of said plural inkjet printheads with an associated one of plural printhead caps to form a sealing chamber surrounding the nozzles between each cap and each printhead;

coupling each seating chamber to a pressure chamber defined by an interior of a pressure chamber structure, with the pressure chamber having a neutral volume before the sealing step;

changing the volume of the pressure chamber during said sealing and thereafter in response to changing ambient environmental conditions external to the pressure chamber structure; and providing a hollow tubular member coupled to the pressure chamber and an ambient port at ambient external environmental conditions, with said hollow tubular member containing a liquid;

wherein said changing comprises moving the liquid in the hollow tubular member between the pressure chamber and the ambient port.

17. A method according to claim 16 further including the step of opening the ambient port of the hollow tubular member prior to the sealing step.

18. A method of sealing nozzles of plural inkjet printheads in an inkjet printing mechanism during periods of printing inactivity, comprising:

sealing each of said plural inkjet printheads with an associated one of plural printhead caps to form a sealing chamber surrounding the nozzles between each cap and each printhead;

coupling each sealing chamber to a pressure chamber defined by an interior of a pressure chamber structure, with the pressure chamber having a neutral volume before the sealing step;

changing the volume of the pressure chamber during said sealing and thereafter in response to changing ambient environmental conditions external to the pressure chamber structure; and wherein said sealing comprises moving a sled which supports each of the plural caps from a rest position to a sealing position, with the sled defining plural ports extending therethrough into a sealing chamber of an associated one of the plural printhead caps;

prior to said sealing, closing each of the plural ports; and wherein said coupling comprises opening each of the plural ports.

19. A method of sealing nozzles of plural inkjet printheads in an inkjet printing mechanism during periods of printing inactivity, comprising:

sealing each of said plural inkjet printheads with an associated one of plural printhead caps to form a sealing chamber surrounding the nozzles between each cap and each printhead;

coupling each sealing chamber to a pressure chamber defined by an interior of a pressure chamber structure, with the pressure chamber having a neutral volume before the sealing step;

changing the volume of the pressure chamber during said sealing and thereafter in response to changing ambient environmental conditions external to the pressure chamber structure;

wherein the pressure chamber structure comprises a bladder member of an elastomeric material supported by the sled;

wherein said changing comprises expanding the bladder member or collapsing the bladder member;

wherein said sealing comprises moving a sled which supports each of the plural caps from a rest position to a sealing position, with the sled defining plural ports extending therethrough into a sealing chamber of an associated one of the plural printhead caps; and wherein said expanding comprises stanching the elastomeric material of the bladder member, while said collapsing comprises conning the elastomeric material of the bladder member.

20. A method of sealing nozzles of plural inkjet printheads in an inkjet printing mechanism during periods of printing inactivity, comprising:

sealing each of said plural inkjet printheads with an associated one of plural printhead caps to form a sealing chamber surrounding the nozzles between each cap and each printhead;

coupling each sealing chamber to a pressure chamber defined by an interior of a pressure chamber structure, with the pressure chamber having a neutral volume before the sealing step;

changing the volume of the pressure chamber during said sealing and thereafter in response to changing ambient environmental conditions external to the pressure chamber structure;

wherein the pressure chamber structure comprises a bladder member;

wherein said changing comprises expanding the bladder member or collapsing the bladder member;

prior to said sealing, biasing the pressure chamber structure to a neutral state with a biasing member; and wherein said expanding comprises stressing the biasing member to a first state, while said collapsing comprises stressing the biasing member to a second state opposite said first state.

21. An inkjet printing mechanism, comprising:

plural inkjet printheads each having nozzles which eject ink;

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position; and a pressure regulating device coupled to isolate the pressure chamber from said external environmental conditions, wherein the pressure regulating device comprises:

a hollow tubular structure coupled to the pressure chamber with the tubular structure having an ambient port at ambient external environmental conditions when the cap sled is in the sealing position; and a liquid housed within the hollow tubular structure between the pressure chamber and the ambient port.

22. An inkjet printing mechanism according to claim 21 wherein the hollow tubular structure comprises a U-shaped tube.

23. An inkjet printing mechanism, comprising:

plural inkjet printheads each having nozzles which sect ink;

a cap sled moveable between a sealing position and a rest position;

plural caps each supported by the sled to engage an associated one of the plural printheads when the sled is in the sealing position to form a sealing chamber surrounding the nozzles between each cap and each printed;

a pressure chamber structure having an interior defining a pressure chamber which is fluidically coupled to each sealing chamber to isolate the sealing chambers from external environmental conditions when the cap sled is in the sealing position, wherein said pressure chamber structure comprises a bladder member which is expandable and collapsible; and wherein the sled defines plural ports therethrough each associated with one of said plural caps to fluidically couple each sealing chamber with the bladder member.

24. An inkjet printing mechanism according to claim 23 wherein the bladder member is of a thin-walled elastomeric material supported by the sled to surround said plural ports.

25. An inkjet printing mechanism, comprising:

plural inkjet printheads each having nozzles which eject ink;

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position, wherein said pressure chamber structure comprises a bladder member which is expandable and collapsible; and a biasing member supported by the bladder member to bias the bladder member to a neutral state, wherein when the sled is in the sealing position, the biasing member expands when the bladder member expands and the biasing member conks when the bladder member collapses.

26. An inkjet printing mechanism according to claim 25 wherein the biasing member is supported by the bladder member inside the pressure chamber.

27. An inkjet printing mechanism, comprising:

plural inkjet printheads each having nozzles which eject ink;

a cap sled moveable between a sealing position and a rest position;

plural caps each supported by the sled to engage an associated one of the plural printheads when the sled is in the sealing position to form a sealing chamber surrounding the nozzles between each cap and each printhead;

a pressure chamber structure having an interior defining a pressure chamber which is fluidically coupled to each sealing chamber to isolate the sealing chambers from external environmental conditions when the cap sled is in the sealing position, wherein said pressure chamber structure comprises a bladder member which is expandable and collapsible;

wherein the sled defines plural ports therethrough to each sealing chamber; and an auxiliary chamber which fluidically couples said plural ports extending through the sled to the pressure chamber of the bladder member.

* * * * *

UNITED STATES PATENT AND TRADEMARK OFFICE

CERTIFICATE OF CORRECTION

PATENT NO. : 6,406,124 B1
DATED : June 18, 2002
INVENTOR(S) : Jeremy A. Davis et al.

It is certified that error appears in the above-identified patent and that said Letters Patent is hereby corrected as shown below:

Column 16,
Line 66, “stanching” should read -- stretching --;

Column 17,
Line 1, “conning” should read -- contracting --;
Line 59, “sect” should read -- eject --;

Column 18,
Line 38, “conks” should read -- contracts --.

Signed and Sealed this

Thirty-first Day of December, 2002

JAMES E. ROGAN
*Director of the United States Patent and Trademark Office*